US005800080A

United States Patent [19]

Lee

[11] Patent Number: 5,800,080

[45] Date of Patent: Sep. 1, 1998

[54] PAPER ADJUSTMENT DEVICE FOR A PRINTER

[75] Inventor: James W. Lee, Groton, N.Y.

[73] Assignee: Axiohm IPB Inc., Ithaca, N.Y.

[21] Appl. No.: 938,791

[22] Filed: Sep. 26, 1997

[51] Int. Cl.[6] ..... B41J 11/20

[52] U.S. Cl. ..... 400/56; 400/59; 347/8

[58] Field of Search ..... 400/120.16, 120.17, 400/56, 57, 58, 59; 347/8, 197, 198

[56] References Cited

U.S. PATENT DOCUMENTS

| | | | |
|---|---|---|---|
| 4,542,690 | 9/1985 | Kikuchi | 400/56 |
| 4,738,552 | 4/1988 | Kikuchi et al. | 400/59 |
| 4,949,098 | 8/1990 | Gluck et al. | 400/56 |
| 5,104,244 | 4/1992 | Eldred et al. | 400/56 |
| 5,479,194 | 12/1995 | Hirano et al. | 347/8 |

FOREIGN PATENT DOCUMENTS

| | | | |
|---|---|---|---|
| 60-101058 | 6/1985 | Japan | 400/59 |
| 61-152477 | 7/1986 | Japan | 400/59 |
| 62-55178 | 3/1987 | Japan | 400/59 |
| 62-128777 | 6/1987 | Japan | 400/59 |
| 4-86278 | 3/1992 | Japan | 400/56 |

*Primary Examiner*—Christopher A. Bennett
*Attorney, Agent, or Firm*—Salzman & Levy

[57] ABSTRACT

A mechanism is provided with a slide adjustment member that is mounted on a frame supporting a carriage assembly of a printer. The carriage assembly is pivotally mounted upon a support shaft carried by a frame. The slide adjustment member has indexing teeth that engage with a plurality of saw-tooth detents. The sawtooth detents are longitudinally disposed upon a surface that is at a slight angle in the range between 3 and 4 degrees, and preferably about 3.44 degrees with respect to the horizontal. Horizontal movement of the slide member over this angled surface causes the carriage assembly to pivot about the support shaft. In so pivoting, the printhead carried upon the carriage assembly is forced to move with respect to the platen, thus changing the paper thickness gap therebetween. Each indexed movement of the slide member past a detent tooth provides a change of 0.003 inches in the gap. This change is equivalent to the difference between single and double ply paper. Thus, the invention provides a simple, low cost slide member and sawtooth index surface for changing the paper gap between the printhead and platen.

13 Claims, 3 Drawing Sheets

PAPER ADJUSTMENT DEVICE FOR A PRINTER

FIELD OF THE INVENTION

This invention relates to paper adjustment devices for printers and, more particularly, to a simple, low cost, slidable mechanism for changing the paper thickness that can be accommodated in a retail receipt printer.

BACKGROUND OF THE INVENTION

In retail establishments, the small receipt printers at checkout counters use rolls of receipt printing paper that may vary in grade and thickness. The thickness and quality of these papers depend upon the manufacturer. Often, retailers will use cheaper, coarser quality papers in order to save money on these consumables. The use of coarser or thicker paper, however, can cause a jam in the printing mechanism.

Manufacturers of these retail printers have attempted to provide means for changing the paper thickness, in order to accommodate for the use of different grades of paper, and to prevent jamming. Prior art adjustment devices have used mechanisms that comprise eccentric journals that are ground on support shafts of the printer. These devices are expensive to manufacture but are not easily adjustable.

The present invention seeks to provide an adjustment mechanism for easily changing the gap between the printhead and the platen in order to accommodate different ply thicknesses of paper.

The current invention also seeks to provide a low cost adjustment mechanism.

The invention comprises a slide adjustment member that is mounted on the carriage assembly of the printer. The carriage assembly is pivotally mounted upon a support shaft carried by the frame. The slide adjustment member has indexing teeth that engage with a plurality of sawtooth detents. The sawtooth detents are longitudinally disposed upon a surface of the carriage with respect to the horizontal movement of the slide member.

The carriage assembly is caused to pivot about the support shaft when the slide member is horizontally slid over the detents, and moves up or down on an angled support member disposed upon the carriage assembly. In so pivoting, the printhead carried upon the carriage assembly is forced to move with respect to the platen, thus changing the paper gap therebetween. Each indexed movement of the slide member past a detent tooth provides a change of 0.003 inches in the gap. Movement past four saw-tooth index positions therefore causes the printhead and platen gap to change by 0.012 inches. A change of one tooth is equivalent to the difference between single and double ply paper. Thus, the invention provides a simple, low cost slide member and saw-tooth index surface for changing the paper gap between the printhead and platen.

SUMMARY OF THE INVENTION

In accordance with the present invention, there is provided a simple, low cost mechanism for changing the gap between the printhead and the platen in a receipt printer. The mechanism comprises a slide adjustment member that is mounted on a frame supporting the carriage assembly of the printer. The carriage assembly is pivotally mounted upon a support shaft carried by the frame. The slide adjustment member has indexing teeth that engage with a plurality of sawtooth detents. The saw-tooth detents are longitudinally disposed upon a surface of the carriage. The slide adjustment member is mounted upon a surface that is at a slight angle in the range between 3 and 4 degrees, and preferably about 3.44 degrees with respect to the horizontal.

Horizontal movement of the slide member over this angled surface causes the carriage assembly to pivot about the support shaft. In so pivoting, the printhead carried upon the carriage assembly is forced to move with respect to the platen, thus changing the paper gap therebetween. Each indexed movement of the slide member past a detent tooth provides a change of 0.003 inches in the gap. Movement past four saw-tooth index positions causes the printhead and platen gap to change by 0.012 inches. A one tooth change is equivalent to the difference between single and double ply paper. Thus, the invention provides a simple, low cost slide member and saw-tooth index surface for changing the paper gap between the printhead and platen.

It is an object of this invention to provide an improved paper thickness adjustment for a printer.

It is another object of the invention to provide a simple, low cost, easily adjustable paper thickness changing mechanism for a receipt printer.

BRIEF DESCRIPTION OF THE DRAWINGS

A complete understanding of the present invention may be obtained by reference to the accompanying drawings, when considered in conjunction with the subsequent detailed description, in which.

For purposes of clarity and brevity, like elements and components will bear the same numerical designation throughout the figures.

DESCRIPTION OF THE PREFERRED EMBODIMENT

Generally speaking, the invention pertains to an adjustment device for changing the gap between the printhead and platen in a receipt printer. The adjustment device allows for the receipt printer to accommodate different thicknesses of paper within the gap. The adjustment device features a slide member that, upon sliding over an angled surface, causes the carriage assembly to pivot, and the printhead to change its position with respect to the platen.

Figure 1:
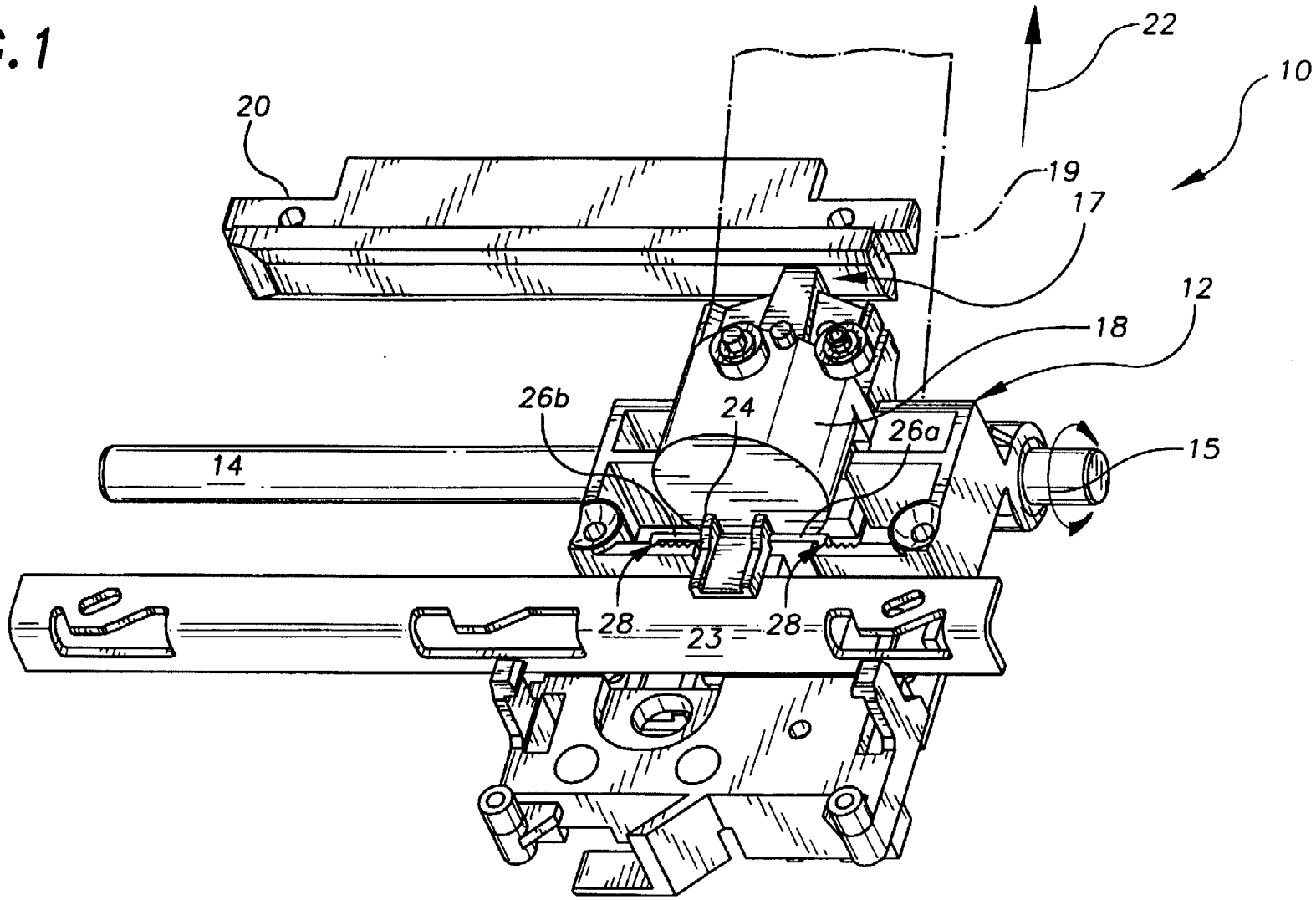
FIG. 1 is a perspective view of a receipt printer illustrating the paper adjustment mechanism of this invention disposed in situ upon the carriage assembly.

Now referring to FIG. 1, a perspective view of a receipt printer 10, is illustrated. The printer 10 comprises a carriage assembly 12 that is pivotable (arrows 15) about a support shaft 14. The carriage assembly 12 supports a printhead 18 that is adjacently contiguous to a platen 20. A gap 17 disposed between the printhead 18 and the platen 20 provides a space for receipt paper 19 (shown in phantom) to movably fit therebetween. The receipt paper 19 is printed with text and/or graphic information by the printhead 18, as it is indexed upwardly (arrow 22) past the printhead 18.

A horizontally disposed frame supported surface 23 carries a slidable adjustment member 24 for slidable movement about the carriage assembly 12, as shown by arrows 25. The slidable adjustment member 24 has two arms **26*a* and 26*b*, respectively. Each arm 26*a* and 26*b* carries an indexing tooth 28, as better observed with reference to FIGS. 2 and 3**.

Figure 2:
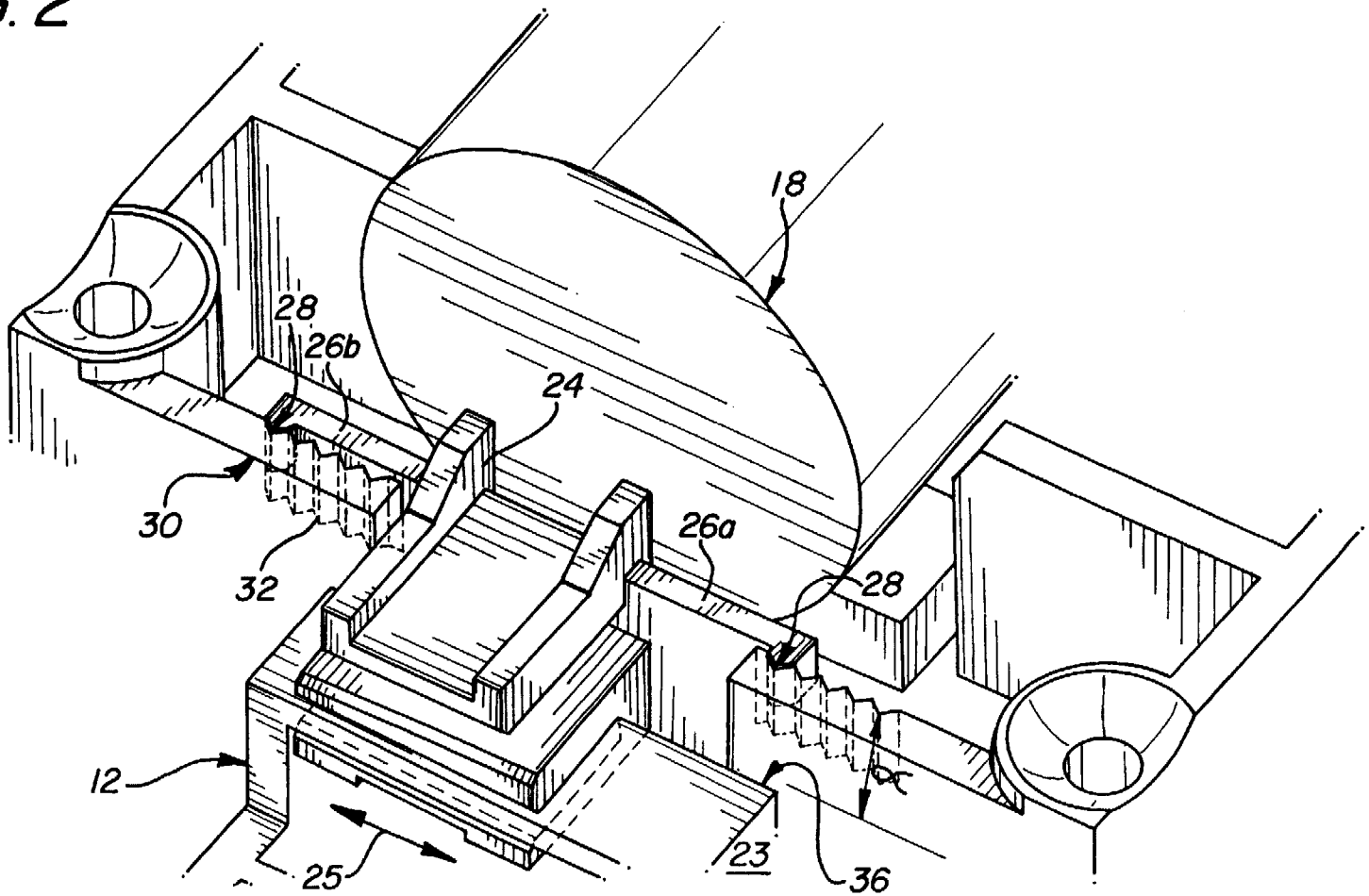
FIG. 2 is an enlarged, perspective view of the slide adjustment mechanism shown in FIG. 1.
Figure 3:
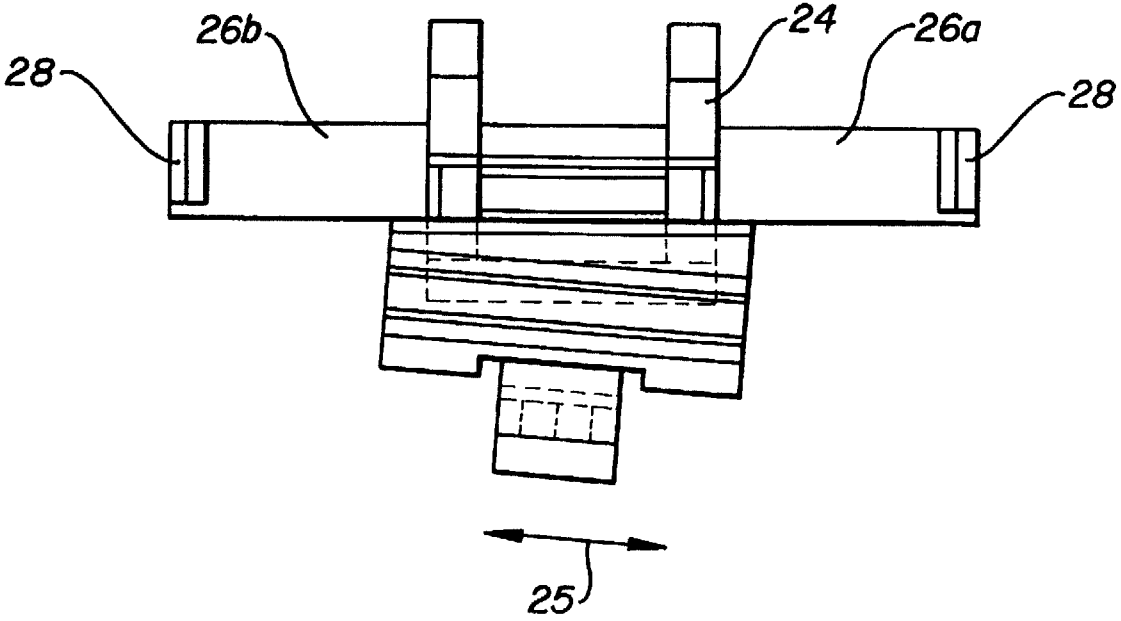
FIG. 3 is a top view of the slide adjustment mechanism, depicted in FIG. 2.

Referring now also to FIGS. 2 and 3, the pair of indexing teeth 28 of the slidable adjustment member 24 are caused to move horizontally (arrows 25) over a toothed surface 30 carried by the carriage assembly 12. The toothed surface 30 comprises a plurality of saw-toothed detents 32, over which each indexing tooth 28 slides. The toothed surface 30 is slightly angled at 3.44 degrees (angle α) with respect to the horizontal surface 36 upon which the slidable adjustment member 24 slides (arrows 25).

Forcing the slide member 24 to slide over (arrows 25) the toothed surface 30, causes the carriage assembly 12 to rotate (arrows 15) toward, and away from the platen 20. This is made possible by the support shaft 14 (FIG. 1) about which the carriage assembly 12 can pivot (arrows 15). In moving forward or backward from the frame supported surface 23, the carriage assembly 12 causes the gap 17 between the printhead 18 and the platen 20 to change.

Each indexed movement of the slide member 24 past a detent tooth 32 disposed on surface 30 provides a change of 0.003 inches in the gap 17. Movement past four saw-tooth index positions therefore causes the printhead and platen gap 17 to change by 0.012 inches. This change is equivalent to the difference between single and double ply paper. Thus, the invention provides a simple, low cost slide member 24 and saw-tooth index surface 30 for changing the paper gap 17 between the printhead 18 and platen 20.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A paper thickness adjustment mechanism for a printer, comprising:

a carriage assembly having a slide support surface for slidably supporting a slide adjustment member, said carriage assembly being movably mounted upon a frame support and having a detented surface that is angled with respect to said slide support surface of said carriage assembly, said carriage assembly supporting a printhead disposed adjacent a platen;

means defining a gap disposed between said printhead and said platen; and a slide adjustment member mounted on the carriage assembly for movement with respect to said carriage assembly, said slide adjustment member having indexing means that is engageable with said detented surface of said carriage assembly as said slide adjustment member is caused to slide upon said detented surface, said movement of said slide member causing said carriage assembly to move with respect to said frame support, wherein said gap between said printhead and said platen is caused to change, and whereby a paper thickness adjustment is provided for the printer.

2. The paper thickness adjustment mechanism for a printer in accordance with claim 1, wherein said detented surface is angled in a range of approximately 3 to 4 degrees with respect to said slide support surface.

3. The paper thickness adjustment mechanism for a printer in accordance with claim 2, wherein said detented surface is angled at about 3.44 degrees with respect to said slide support surface.

4. The paper thickness adjustment mechanism for a printer in accordance with claim 1, wherein said detented surface comprises a plurality of detent teeth.

5. The paper thickness adjustment mechanism for a printer in accordance with claim 4, wherein each of said detent teeth of said plurality of detent teeth provides an approximate change of 0.003 inches in said gap.

6. The paper thickness adjustment mechanism for a printer in accordance with claim 4, wherein movement of said slide adjustment member past one of said plurality of detent teeth provides a change in thickness in said gap equivalent to the change of thickness between a single ply and a double ply of paper.

7. A paper thickness adjustment mechanism for a receipt printer, comprising:

a platen;

a slide adjustment member for changing a thickness of paper in said receipt printer;

a carriage assembly having a slide support surface for slidably supporting said slide adjustment member, said carriage assembly having a detented surface that is angled with respect to said slide support surface, said carriage assembly supporting a printhead;

a printhead disposed adjacent said platen for printing indicia upon a paper to provide a receipt;

means defining a gap disposed between said printhead and said platen; and indexing means carried by said slide adjustment member, said indexing means being engageable with said detented surface of said carriage assembly as said slide adjustment member is caused to slide upon said detented surface, said movement of said slide member causing said carriage assembly to move with respect to said frame support, wherein said gap between said printhead and said platen is caused to change, and whereby a paper thickness adjustment is provided.

8. The paper thickness adjustment mechanism for a printer in accordance with claim 7, wherein said detented surface is angled in a range of approximately 3 to 4 degrees with respect to said slide support surface.

9. The paper thickness adjustment mechanism for a printer in accordance with claim 8, wherein said detented surface is angled at about 3.44 degrees with respect to said slide support surface.

10. The paper thickness adjustment mechanism for a printer in accordance with claim 7, wherein said detented surface comprises a plurality of detent teeth.

11. The paper thickness adjustment mechanism for a printer in accordance with claim 10, wherein each of said detent teeth of said plurality of detent teeth provides an approximate change of 0.003 inches in said gap.

12. The paper thickness adjustment mechanism for a printer in accordance with claim 10, wherein movement of said slide adjustment member past one of said plurality of detent teeth provides a change in thickness in said gap equivalent to the change of thickness between a single and a double ply of paper.

13. A paper thickness adjustment mechanism for a printer, comprising:

a carriage assembly having a slide support surface for slidably supporting a slide adjustment member, said carriage assembly being pivotally mounted upon a frame support and having a detented surface that is angled with respect to said slide support surface of said carriage assembly, said carriage assembly supporting a printhead disposed adjacent a platen;

means defining a gap disposed between said printhead and said platen; and a slide adjustment member mounted on the carriage assembly for movement with respect to said carriage assembly, said slide adjustment member having indexing means that is engageable with said detented surface of said carriage assembly as said slide adjustment member is caused to slide upon said detented surface, said movement of said slide member causing said carriage assembly to pivot with respect to said frame support, wherein said gap between said printhead and said platen is caused to change, and whereby a paper thickness adjustment is provided for the printer.

* * * * *